United States Patent [19]

Ueno et al.

[11] 4,103,653

[45] Aug. 1, 1978

[54] METHOD OF AND APPARATUS FOR CONTROLLING IGNITION TIMING OF AN INTERNAL COMBUSTION ENGINE

[75] Inventors: Zene Ueno, Fuchu; Akira Morita, Tokyo; Atushi Chida, Sayama, all of Japan

[73] Assignee: Nissan Motor Company, Limited, Japan

[21] Appl. No.: 635,867

[22] Filed: Nov. 28, 1975

[51] Int. Cl.[2] ..... F02P 5/04

[52] U.S. Cl. ..... 123/117 R; 123/121; 123/127

[58] Field of Search ..... 123/1 A, 1 R, DIG. 12, 123/121, 117 A, 117 R, 3, 127

[56] References Cited

U.S. PATENT DOCUMENTS

| | | | |
|---|---|---|---|
| 1,262,034 | 4/1918 | Frazer | 123/DIG. 2 |
| 2,444,199 | 6/1948 | Klaburner | 123/121 |
| 3,162,184 | 12/1964 | Walker | 123/117 A |
| 3,799,124 | 3/1974 | Swain | 123/1 A |
| 3,906,913 | 9/1975 | Rupe | 123/121 |
| 3,939,806 | 2/1976 | Bradley | 123/1 A X |
| 4,013,050 | 3/1977 | Lace | 123/127 X |

*Primary Examiner*—Charles J. Myhre
*Assistant Examiner*—Tony M. Argenbright
*Attorney, Agent, or Firm*—Robert E. Burns; Emmanuel J. Lobato; Bruce L. Adams

[57] ABSTRACT

The ignition timing of an engine is controlled to an optimum value in accordance with the amount of hydrogen supplied as an auxiliary fuel to the engine in addition to a main fuel.

7 Claims, 3 Drawing Figures

METHOD OF AND APPARATUS FOR CONTROLLING IGNITION TIMING OF AN INTERNAL COMBUSTION ENGINE

BACKGROUND OF THE INVENTION

The present invention relates generally to controlling the ignition timing of a spark ignition type internal combustion engine run on a lean air-hydrocarbon fuel mixture which is supplied with hydrogen as an auxiliary fuel in addition to the hydrocarbon fuel and particularly to a method and an apparatus in which the ignition timing of an engine of this type is controlled in accordance with the amount of hydrogen supplied to the engine.

As a solution to the problem of reducing the production of air pollutants such as hydrocarbons (HC), carbon monoxide (CO) and nitrogen oxides (NOx) contained in exhaust gases discharged from an internal combustion engine, it is well known in the art to set the air-hydrocarbon fuel mixture of the engine considerably lean and concurrently to supply the engine with hydrogen to complement the hydrocarbon fuel thereof. In this instance, the engine has an optimum ignition timing or advance at which the output of the engine is maximized and the air pollutant content in the engine exhaust gases is minimized and which varies with the ratio of the amount of hydrogen supplied to the engine to that of the hydrocarbon fuel, for example, gasoline, supplied thereto.

An experiment confirmed the fact that the optimum ignition advance of an internal combustion engine is reduced and increased in accordance with sensed or controlled increases and decreases in the amount of hydrogen supplied to the engine relative to that of the hydrocarbon fuel supplied thereto, respectively. The experiment particularly revealed the following facts:

(1) Optimum or ideal vacuum and centrifugal advance characteristics of the engine supplied with hydrogen are substantially similar respectively to those of an engine supplied with no hydrogen.

(2) Under the condition that engine intake manifold vacuum is constant, when an air-hydrocarbon fuel ratio (A/F) of the air-hydrocarbon fuel mixture of the engine is varied by making the flow rate of hydrogen supplied to the engine constant and by varying the flow rate of hydrocarbon fuel supplied to the engine, the optimum ignition advance of the engine is increased as the air-hydrocarbon fuel ratio is increased.

SUMMARY OF THE INVENTION

It is, therefore, an object of the invention to provide a method of and an apparatus for controlling the ignition timing of an internal combustion engine, supplied with a lean air-hydrocarbon fuel mixture and hydrogen, to an optimum value in accordance with the amount of hydrogen supplied to the engine so that the output of the engine is maximized and the content of air pollutants in exhaust gases of the engine is minimized.

BRIEF DESCRIPTION OF THE DRAWINGS

This and other objects and advantages of the invention will become more apparent from the following detailed description taken in connection with the accompanying drawings in which.

DESCRIPTION OF THE PREFERRED EMBODIMENTS

Figure 1:
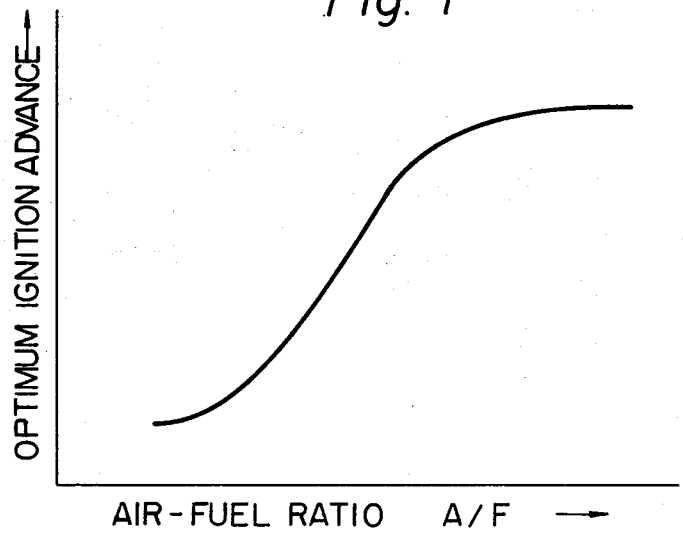
FIG. 1 is a graphic representation of the relationship between the air-fuel ratio of the air-fuel mixture of an internal combustion engine and the optimum ignition advance.

Referring to FIG. 1 of the drawings, there is shown the relationship between the air-fuel ratio of the air-fuel mixture of an engine and the optimum ignition timing advance of the engine which is stated in the introduction of the specification and which results from the experiment.

Figure 2:
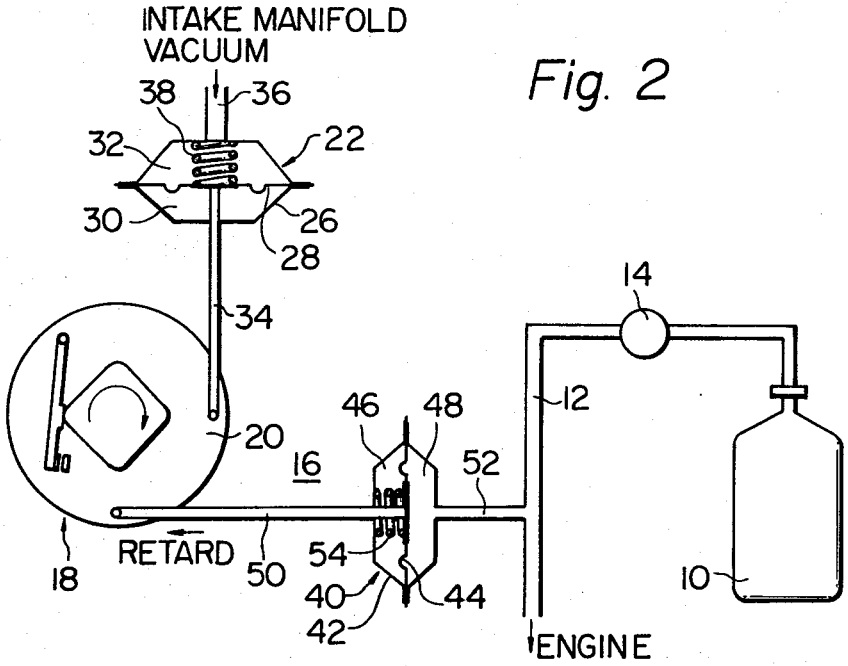
FIG. 2 is a schematic view of a first preferred embodiment of an ignition timing control apparatus according to the invention.

Referring to FIG. 2 of the drawings, an ignition timing control apparatus according to the invention is shown as comprising a source of hydrogen such as, for example, a container 10 storing hydrogen gas under pressure which is supplied as an auxiliary fuel to an internal combustion engine (not shown) in addition to a main fuel such as a hydrocarbon fuel. This is to supply the engine with a considerably lean air-hydrocarbon fuel mixture to reduce the contents of air pollutants such as hydrocarbons (HC), carbon monoxide (CO) and nitrogen oxides (NOx) in exhaust gases discharged from the engine. A conduit 12 leads from the source 10 of hydrogen to an induction passage or system (not shown) or a combustion chamber (not shown) of the engine for supplying hydrogen thereto. A pressure reducing and flow control valve 14 is disposed in the passage 12 to adjust or meter to a predetermined or desired value in known manner the ratio of the flow rate of hydrogen to the flow rate of the hydrocarbon fuel fed to the engine.

The ignition timing control apparatus, generally designated by the reference numeral 16, is also shown as comprising or being combined with an ignition distributor 18 for controlling the ignition timing of the engine and having a centrifugal advance mechanism and a vacuum advance mechanism. The ignition distributor 18 also has a breaker plate 20 rotatable in opposite directions and reduces and increases the ignition advance or retard and advance the ignition timing of the engine when the breaker plate 20 is rotated, for example, clockwise and counterclockwise in the drawing, respectively.

A first control device 22 is connected to the breaker plate 20 for controlling the ignition timing of the engine in accordance with vacuum in an intake manifold (not shown) of the engine or the induction passage at a location downstream of a throttle valve (not shown) of the engine. The first control device 22 is a conventional diaphragm assembly and comprises a housing 26, a pressure sensitive deformable member such as a flexible diaphragm 28 dividing the interior of the housing 26 into first and second chambers 30 and 32, and an operating rod 34 fixedly secured at one end to the diaphragm 28 and operatively connected at the other end to the breaker plate 20. The first chamber 30 communicates with the outside atmosphere through a vent, while the second chamber 32 communicates through a conduit 36 with the intake manifold of the engine or the induction passage at a location downstream of the throttle valve of the engine. A flexible elastic member such as a spring 38 is provided to urge the diaphragm 28 in a direction opposed by the pressure in the first chamber 30. The diaphragm 28 is moved to cause the ignition distributor 18 to advance and retard the ignition timing of the engine in response to increases and decreases in the vacuum in the induction passage at a location downstream of the throttle valve, respectively.

A second control device 40 is connected to the breaker plate 20 for controlling the ignition timing of the engine in accordance with the amount of hydrogen supplied to the engine through the conduit 12. The second control device 40 comprises a housing 42, a pressure sensitive deformable member such as a flexible diaphragm 44 which divides the interior of the housing 42 into first and second chambers 46 and 48, and an operating rod 50 fixedly secured at one end to the diaphragm 44 and operatively connected at the other end to the breaker plate 20. The first chamber 46 communicates with the outside atmosphere through a vent, while the second chamber 48 communicates with the conduit 12 through a conduit 52. The second chamber 48 is located with respect to the ignition distributor 18 so that the diaphragm 44 is moved to cause the ignition distributor 18 to retard and advance the ignition timing of the engine in response to increases and decreases in the pressure of hydrogen in the second chamber 48, respectively. A flexible elastic member such as a spring 54 is provided to urge the diaphragm 44 in a direction opposed by the pressure of hydrogen in the second chamber 48.

The ignition timing control apparatus 16 thus far described is operated as follows:

When the amount of hydrogen supplied to the engine is increased by the operation of the flow control valve 14 in known manner such as, (e.g., by an accelerator linked to valve 14), the pressure of hydrogen in the conduit 12 is increased to move the diaphragm 44 and the operating rod 50 leftward in the drawing so that the breaker plate 20 is rotated clockwise to retard the ignition timing of the engine. On the contrary, when the amount of hydrogen supplied to the engine is reduced, the pressure of hydrogen in the conduit 12 is reduced to move the diaphragm 44 and the operating rod 50 rightward in the drawing so that the breaker plate 20 is rotated counterclockwise to advance the ignition timing of the engine. Thus, an optimum ignition timing of the engine is maintained to maximize the output performance of the engine and to minimize the content of air pollutants in the engine exhaust gases.

Figure 3:
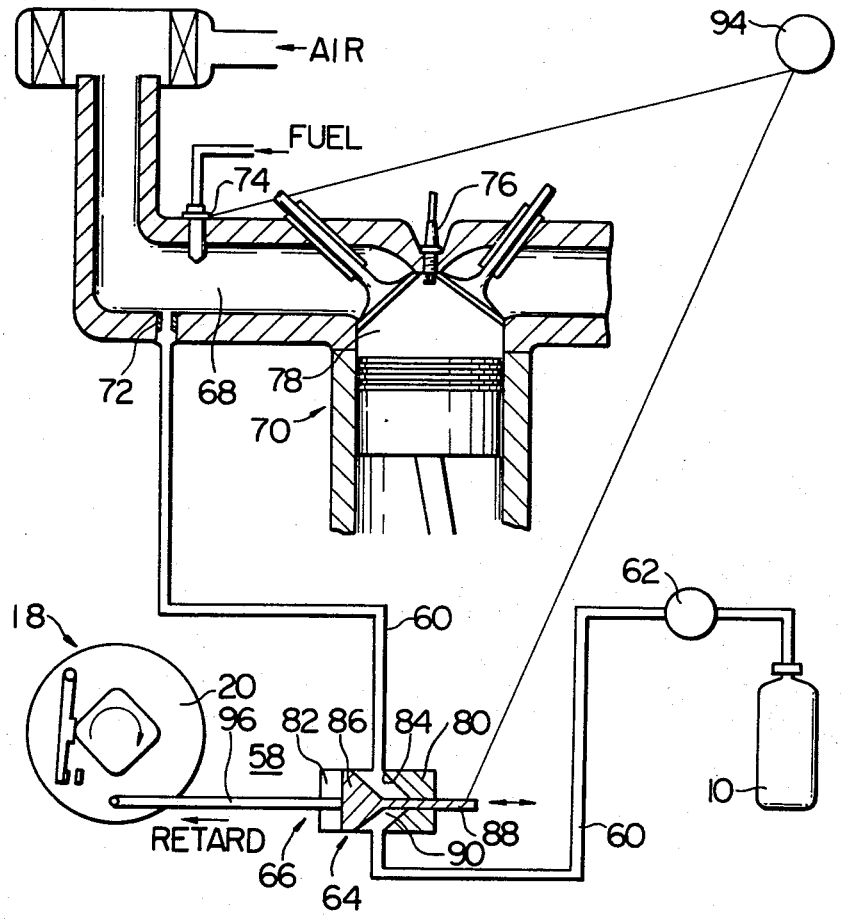
FIG. 3 is a schematic view of a second preferred embodiment of an ignition timing control apparatus according to the invention.

Referring to FIG. 3 of the drawings, there is shown a second preferred embodiment of an ignition timing control apparatus according to the invention which is applied to an internal combustion engine 70 of a fuel injection type. The ignition timing control apparatus, generally designated by the reference numeral 58, is different from the ignition timing control apparatus 16 shown in FIG. 2 in that it comprises a passage 60; a pressure reducing valve 62, a flow control valve 64; and a second control device 66 in place of the passage 12, the flow control valve 14 and the first and second control devices 22 and 40 of the ignition timing control apparatus 16. In FIG. 3, like component elements are designated by the same reference numerals as those used in FIG. 2. Since the engine 70 is provided with no throttle valve, air is freely drawn into the engine irrespective of the output of the engine 70 and the engine output is controlled by the amount of hydrocarbon fuel injected to the engine or an air-hydrocarbon fuel ratio.

As shown in FIG. 3, the conduit 60 leads from a source 10 of hydrogen to an induction passage 68 of the engine 70 for supplying hydrogen thereto. An orifice 72 is formed in the passage 60 and opens into the induction passage 68. The engine 70 includes a fuel injection valve 74 positioned at the induction passage 68 for injecting the main fuel thereinto, and a spark plug 76 positioned in a combustion chamber 78 of the engine 70.

The flow control valve 64 is disposed in the conduit 60 between the pressure reducing valve 62 and the induction passage 68 and constitutes a part of the second control device 66. The flow control valve 64 is a lift or tappet valve and comprises a housing 80 formed therein with a cavity 82 into which the conduit 60 opens, a valve seat 84 formed in the cavity 82, a valve head 86 slidably fitted in the cavity 82, and a valve rod 88 extending from the valve head 86 externally of the housing 80. The valve head 86 is movable toward or away from the valve seat 84 to vary the opening degree 90 of the valve 64. The fuel injection valve 74 and the valve rod 88 of the flow control valve 64 are connected to or cooperate with for example, an accelerator pedal 94 of the engine 70 so that the valve 64 is opened and closed in synchronism with the fuel injection valve 74 to control to a predetermined or desired value the ratio of the amount or flow rate of hydrogen supplied to the engine 70 to the amount or flow rate of the main fuel injected through the fuel injection valve 74 to the engine 70. The pressure reducing valve 62 is disposed in the conduit 60 at a location upstream of the flow control valve 64 for maintaining the pressure of the hydrogen supplied thereto at a predetermined value.

The second control device 66 is operable to cause the ignition distributor 18 to control the ignition timing of the engine 70 in accordance with the degree of opening of the flow control valve 64 and comprises the flow control valve 64 and an operating stem 96 fixedly secured at one end to the valve head 86 and operatively connected at the other end to the breaker plate 20 of the ignition distributor 18. The valve head 86 is located with respect to the ignition distributor 18 so that the valve head 86 operates the ignition distributor 18 through rod 96 to cause it to retard and advance the ignition timing of the engine 70 in accordance with increases and decreases in the degree of opening of the flow control valve 64, respectively.

The ignition timing control apparatus 58 thus far described in operated as follows:

When the flow control valve 64 is moved in a direction to increase the amount of hydrogen supplied to the engine 70 in accordance with an increase in the amount of the main fuel supplied to the engine 70, that is, a decrease in an air-hydrocarbon fuel ratio, through the fuel injection valve 74, the operating rod 96 is moved leftwards in the drawing so that the breaker plate 20 is rotated clockwise to retard the ignition timing of the engine 70. On the contrary, when the opening degree of the valve 64 is reduced to reduce the amount of hydrogen supplied to the engine 70 in accordance with a decrease in the amount of the main fuel supplied to the engine 70, that is, an increase in the air-hydrocarbon fuel ratio, the operating rod 96 is moved rightwards in the drawing so that the breaker plate 20 is rotated counterclockwise to advance the ignition timing of the engine 70. Thus, the ignition timing of the engine 70 is controlled to an optimum value as a function of the amounts of the main fuel and hydrogen supplied to the engine 70.

It will be appreciated that the invention provides a method and an apparatus in which the ignition timing of an internal combustion engine is controlled to an optimum value in accordance with the amount of hydrogen supplied as an auxiliary fuel to the engine in addition to a main fuel so that the output of the engine is maximized and the content of air pollutants in exhaust gases of the engine is minimized.

What is claimed is:

1. An ignition timing control apparatus in combination with an internal combustion engine including an ignition distributor, a source of auxiliary fuel, and conduit means for providing communication between said source of auxiliary fuel and said engine for feeding auxiliary fuel thereinto in addition to a main fuel, said apparatus comprising variable control means for communicating with said conduit means and the position of which is varied in accordance with the amount of said auxiliary fuel fed to said engine, and connecting means for operatively connecting said variable control means to said ignition distributor for variably controlling the ignition timing of said engine in accordance with the position of said variable control means.

2. An ignition timing control apparatus in combination with an internal combustion engine including an ignition distributor, a source of hydrogen, and conduit means for providing communication between said source of hydrogen and said engine for feeding hydrogen as an auxiliary fuel thereinto in addition to a main fuel, said apparatus comprising variable control means for communicating with said conduit means and the position of which is varied in accordance with the amount of said hydrogen fed to said engine, and connecting means for operatively connecting said control means to said ignition distributor for variably controlling the ignition timing of said engine in accordance with the position of said variable control means.

3. An ignition timing control apparatus in combination with an internal combustion engine including means for defining an intake passageway having a throttle valve rotatably mounted therein, an ignition distributor having a breaker plate, a diaphragm assembly including a flexible diaphragm having a fluid chamber on a side thereof, a connecting rod operatively connecting said diaphragm to said breaker plate, passage means for providing communication between said fluid chamber and said intake passageway downstream of said throttle valve, a source of hydrogen, and conduit means for providing communication between said source of hydrogen and said engine for feeding hydrogen as an auxiliary fuel thereinto in addition to a main fuel, said apparatus comprising variable control means communicating with said conduit means and the position of which is varied in accordance with the amount of said hydrogen fed to said engine, and connecting means for operatively connecting said control means to said breaker plate for variably controlling the ignition timing of said engine in accordance with the position of said variable control means.

4. An ignition timing control apparatus in combination with an internal combustion engine including an ignition distributor, a source of hydrogen, and first passage-defining means for providing communication between said source of hydrogen and said engine for feeding hydrogen as an auxiliary fuel thereinto in addition to a main fuel, said apparatus comprising a diaphragm assembly comprising a flexible diaphragm having a fluid chamber on a side thereof, second passage-defining means for providing communication between said first passage-defining means and said fluid chamber for variably moving said diaphragm in accordance with the amount of said hydrogen fed to said engine, and an operating rod for operatively connecting said diaphragm to said ignition distributor for varying the ignition timing of said engine in accordance with the position of said diaphragm so that the ignition timing of said engine is variably retarded and variably advanced in accordance with variable increases and variable decreases in the amount of said hydrogen fed to said engine, respectively.

5. An ignition timing control apparatus in combination with an internal combustion engine including an ignition distributor, a source of hydrogen, conduit means for providing communication between said source of hydrogen and said engine for feeding hydrogen as an auxiliary fuel thereinto in addition to a main fuel, and a variable flow control valve movably disposed in said conduit means for variably controlling the flow of said hydrogen fed to said engine, said apparatus comprising an operating rod for operatively connecting said flow control valve to said ignition distributor for varying the ignition timing of said engine in accordance with the position of said variable flow control valve.

6. An ignition timing control apparatus in combination with an internal combustion engine including an ignition distributor, a source of hydrogen, and conduit means for providing communication between said source of hydrogen and said engine for feeding hydrogen as an auxiliary fuel thereinto in addition to a main fuel, said apparatus comprising variable control means for communicating with said conduit means and the position of which is varied in accordance with the amount of said hydrogen fed to said engine, and connecting means for operatively connecting said control means to said ignition distributor for variably controlling the ignition timing of said engine in accordance with the position of said variable control means; said variable control means comprising a housing, a flexible diaphragm dividing the interior of said housing into a first chamber communicating with the outside atmosphere and a second chamber communicating with said conduit means, an operating rod fixedly secured at one end to said diaphragm and operatively connected at the other end to said ignition distributor, said second chamber being located with respect to said ignition distributor so that said diaphragm is moved to cause said ignition distributor to retard and advance the ignition timing of said engine in response to increases and decreases in the pressure of hydrogen in said second chamber, respectively, and biasing means urging said diaphragm in a direction opposed by the pressure of hydrogen in said second chamber.

7. An ignition timing control apparatus in combination with an internal combustion engine including an ignition distributor, a source of hydrogen, and conduit means for providing communication between said source of hydrogen and said engine for feeding hydrogen as an auxiliary fuel thereinto in addition to a main fuel, said apparatus comprising variable control means for communicating with said conduit means and the position of which is varied in accordance with the amount of said hydrogen fed to said engine, and connecting means for operatively connecting said control means to said ignition distributor for variably controlling the ignition timing of said engine in accordance with the position of said variable control means, said variable control means comprises a variable flow control valve disposed in said conduit means, said variable flow control valve comprising a valve seat and a valve head movable with respect to said valve seat to vary the degree of opening of said variable flow control valve, and an operating rod fixedly secured at one end to said valve head and operatively connected at the other end to said ignition distributor so that said ignition distributor is caused to retard and advance the ignition timing of said engine in accordance with increases and decreases in the degree of opening of the variable flow control valve, respectively.

* * * * *